United States Patent [19]

Hofmann

[11] Patent Number: 4,995,752

[45] Date of Patent: Feb. 26, 1991

[54] ORDERING MEANS FOR DOCUMENT FILES OR THE LIKE

[75] Inventor: Jörg Hofmann, Kreuzwertheim, Fed. Rep. of Germany

[73] Assignees: Gudrun Hofmann; Raimund Hofmann, both of Kreuzwertheim, Fed. Rep. of Germany

[21] Appl. No.: 447,953

[22] Filed: Dec. 7, 1989

Related U.S. Application Data

[63] Continuation of Ser. No. 173,974, Mar. 28, 1988, Pat. No. 4,948,286.

[51] Int. Cl.[5] ..... B42F 13/24

[52] U.S. Cl. ..... 402/34; 402/38; 402/44

[58] Field of Search ..... 402/34, 38, 41

[56] References Cited

U.S. PATENT DOCUMENTS

| | | | |
|---|---|---|---|
| 2,789,561 | 4/1957 | Bonn et al. | 402/41 X |
| 4,415,290 | 11/1983 | Ohminato | 402/34 |
| 4,486,112 | 12/1984 | Cummins | 402/41 X |

FOREIGN PATENT DOCUMENTS

| | | | |
|---|---|---|---|
| 910531 | 5/1954 | Fed. Rep. of Germany . | |
| 1183048 | 12/1964 | Fed. Rep. of Germany | 402/34 |
| 3004830 | 8/1980 | Fed. Rep. of Germany | 402/38 |
| 8218793 | 10/1982 | Fed. Rep. of Germany . | |
| 36050 | 11/1910 | Sweden | 402/34 |

*Primary Examiner*—Paul A. Bell

*Attorney, Agent, or Firm*—Townsend and Townsend

[57] ABSTRACT

An ordering means for document files or the like comprises a base plate which is provided with at least two fixed ordering pins. At least one movable closure bow can be brought into closure contact with the ordering pins. Possibly a holder-down is provided which is adapted to be clamped with respect to the ordering pins. A locking member displaceable with respect to the base plate serves to adjust the closure bow or bows and on the base plate guide means are provided for guiding the locking member. The locking member is provided with the guide slots or guide grooves via which the locking member is in engagement with each closure bow so that on displacement of the locking member the respective closure bow can be opened or closed.

17 Claims, 10 Drawing Sheets

ORDERING MEANS FOR DOCUMENT FILES OR THE LIKE

This application is a continuation of application Ser. No. 07/173,974, filed Mar. 28, 1988 now U.S. Pat. No. 4,948,286.

BACKGROUND OF THE INVENTION

The invention relates to an ordering means for document files or the like comprising a base plate having at least two fixed ordering pins and at least one movable closure bow and in case a holder-down adapted to be brought into engagement with the ordering pins.

An ordering means of the type mentioned at the beginning is known from DE-GM 8,218,793 and consists of a plurality of parts, for example 16 individual parts, which are mainly of metal and must be assembled before the ordering means can be secured by means of rivets or the like in a file.

DE-PS 910,531 describes a further ordering means in conjunction with a holder-down which for holding the documents to be ordered down is clamped with respect to the ordering pins. This ordering means also consists of a great number of individual parts which must be assembled in comparatively complicated manner before the means itself can be inserted in a file.

SUMMARY OF THE INVENTION

The invention is based on the problem of further developing an ordering means of the type mentioned at the beginning in such a manner that it consists of a minimum number of parts which can easily and rapidly be assembled and in particular permit economic production.

This problem is solved according to the invention in that a locking member displaceable with respect to the base plate is provided, guide means being arranged on the base plate for guiding the locking member, and that the locking member has guide slots or guide grooves via which the locking member is in engagement with each closure bow and on displacement of the locking member the respective closure bow is opened or closed.

Further embodiments are set forth in the subsidiary claims.

The invention provides an ordering means which in the basic construction consists of only four or five individual parts. A base plate on which the ordering pins are integrally formed projecting vertically upwardly comprises openings for insertion of the closure bow or closure bows and guide means for a locking member which is displaceable in the direction of the longitudinal axis of the base plate for the purpose of opening and closing the locking bow or bows. Preferably, the base plate, the locking member, the holder-down and the ordering pins consist of plastic whilst the closure bow or shackle consists in known manner of metal or alternatively also of plastic, preferably of glassfibre-reinforced plastic. Thus, as required some or all of said individual parts may be made from metal or plastic.

The ordering means according to the invention is particularly suitable for use in document files or the like with small or medium back width but can also be used on appropriate formation of the locking member for large document files, i.e. for files of large stack height in which a comparatively large opening angle of the closure bow or bows is desired The holder-down consists according to the present invention preferably of plastic and has no additional means, for example in the form of spring wires or the like serving for clamping with respect to the ordering pins.

Hereinafter preferred embodiments of the ordering-means will be described for explaining further features with the aid of the drawings, wherein:

DETAILED DESCRIPTION OF THE PREFERRED EMBODIMENT

Figure 1:
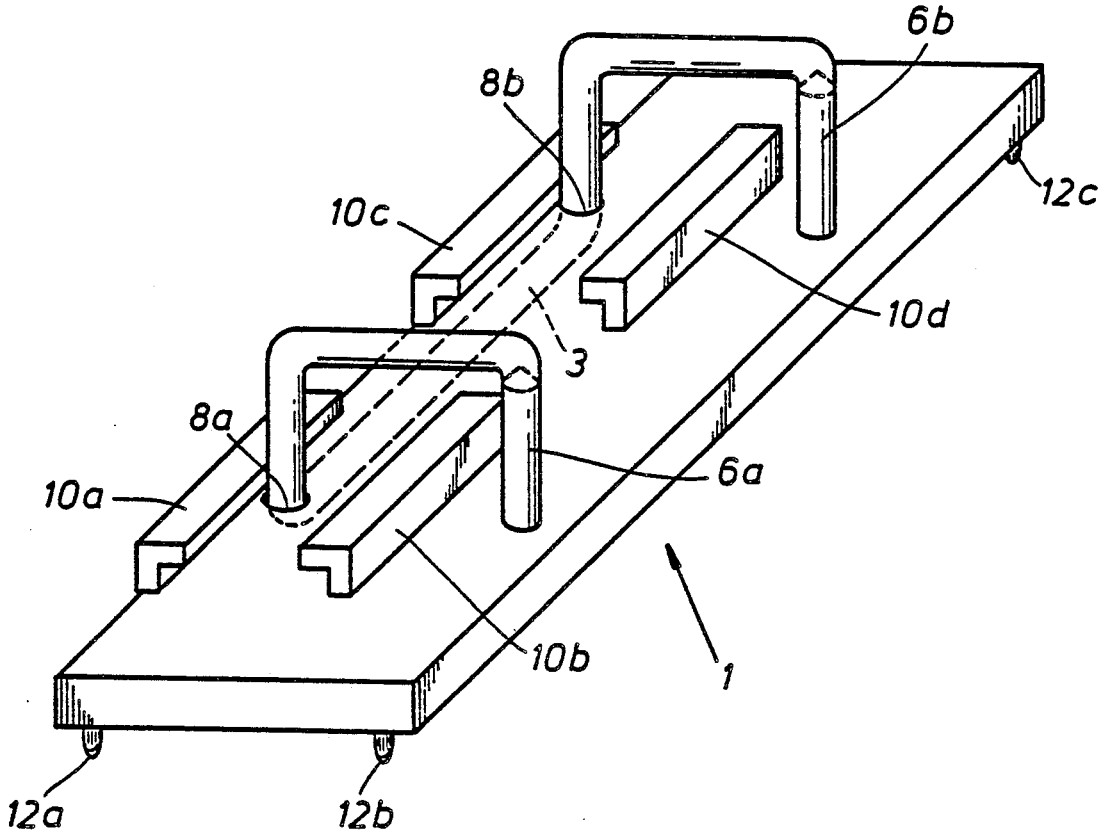
FIG. 1 is a perspective view of the base plate according to a first embodiment.
Figure 2:
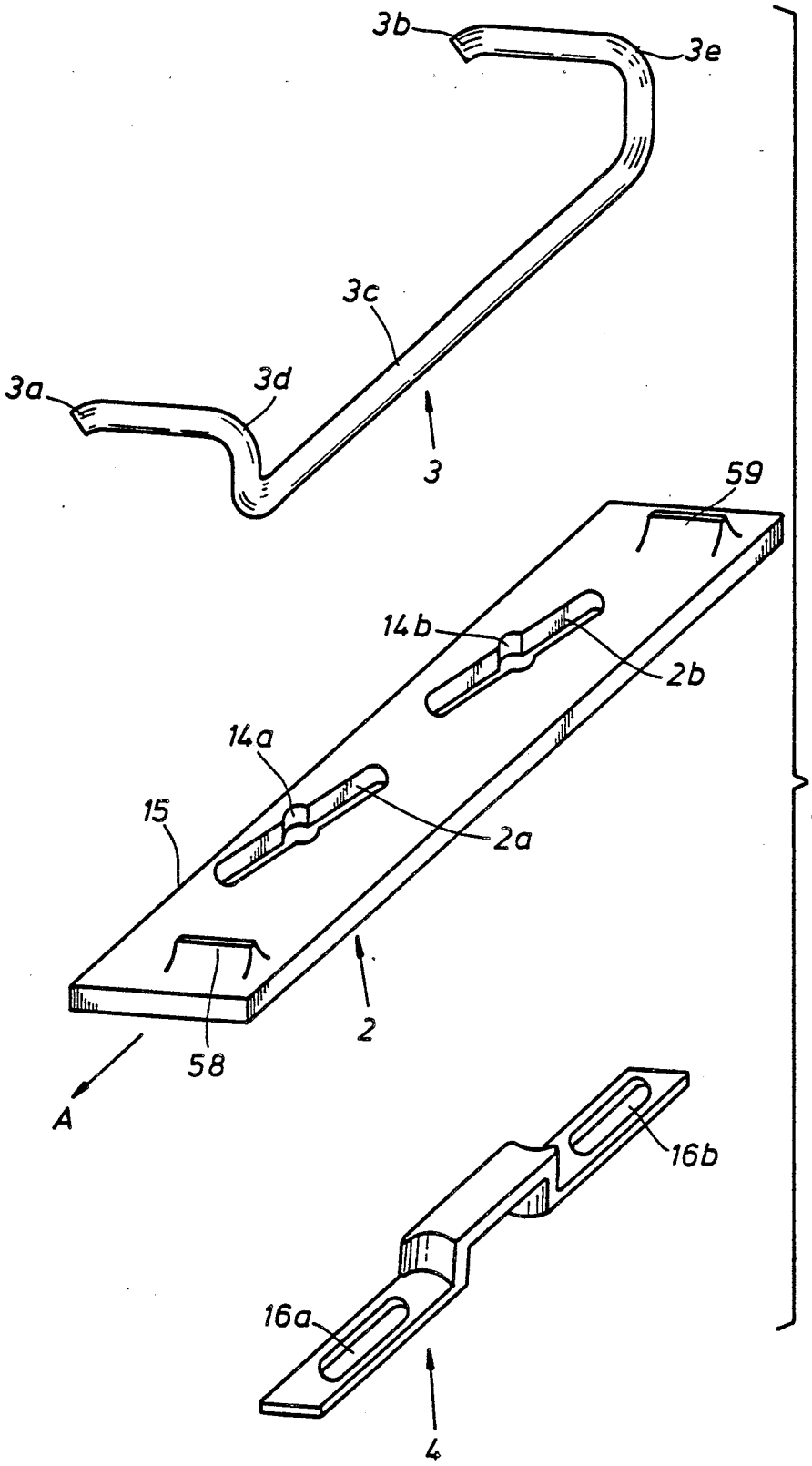
FIG. 2 is an exploded perspective view of the locking member, the closure shackle or bow, and the holder-down for the first embodiment.

FIGS. 1 and 2 show a first preferred embodiment of an ordering means for document files or the like which consists of a base plate 1, a locking member 2, a closure bow 3 and a holder-down 4.

On the base plate 1, which preferably has a substantially rectangular shape, at least two ordering pins 6*a*, 6*b* are provided which project upright from the base plate 1 and at their free end have an engagement face for the free ends of a closure bow 3. The ordering pins 6*a*, 6*b* may be formed as integral parts of the base plate or secured as metal pins to the base plate 1. The base plate 1 is provided on the side remote from the ordering pins 6*a*, 6*b* with opening or bores 8*a*, 8*b* serving for passage of the closure bow 3. The closure bow 3 (FIG. 2) is led from the lower side of the base plate 1 through the openings 8*a*, 8*b* in such a manner that the free ends 3*a*, 3*b* of the closure bow are adapted to engage the ordering pins 6*a*, 6*b* in such a manner that with the form of the closure bow 3 shown in FIG. 2 the curved portions 3*d*, 3*e* bent up from the elongated connecting portion 3*c* come to lie in the regions of the openings 8*a*, 8*b*. The bend portions 3*e*, 3*d* project upwardly substantially vertically from the connecting portion 3*c* and merge into the substantially extending end portions as shown in FIG. 2. The closure bow thus has substantially as a whole the form of a horn. The elongated connecting portion 3*c* between the two bow ends 3*a*, 3*b* remains in this embodiment beneath the base plate 1 or in engagement with the lower surface of the base plate 1 so that the closure bow 3 is mounted in the openings 8*a*, 8*b* pivotally with respect to the base plate 1. Before insertion of the closure bow 3 through the openings 8*a*, 8*b* of the base plate 1 the locking member 2 is inserted into guide means formed on the upper side of the base plate 1. The locking member 2 is brought into a position such that the closure bow 3 can be inserted in simple manner through the openings 8a, 8b in the base plate 1 on the one hand and through the openings or slots 2a, 2b of the locking member on the other hand and thus into the operating position.

As guide means in the embodiment of FIG. 1 rails or lugs 10a, 10b, 10c, 10d are provided which have a substantially L-shaped profile and of which the guide rails 10a, 10c and 10b, 10d respectively are provided one behind the other on the upper surface of the base plate 1 and form a guide groove. The guide rails 10a, 10b on the one hand and the guide rails 10c, 10d on the other hand lie opposite each other so that the displacement of the locking member is fixed in a direction extending parallel to the longitudinal axis of the base plate 1. The L-shaped guide rails 10a to 10d engage over the locking member 2 and thus prevent a shifting of the locking member 2 upwards away from the base plate 1. Although in this embodiment the guide rails 10a to 10d engage over the locking member 2 they may be made if required also as simple strips which do not engage over the locking member 2 so that only a lateral guiding for the locking member 2 is provided. Fundamentally, instead of the guide rails 10a to 10d shown in FIG. 1 guide pins or the like may be provided which by notches have a profile corresponding to the guide rails 10a to 10d of FIG. 1 or a circular cross-section. In known manner at the lower side of the base plate 1 pins 12a, 12b, etc. are provided which serve to secure the base plate 1 to the document file.

As clearly apparent from FIG. 2 the locking member 2 consists according to a first embodiment of a plate-shaped part which has slots 2a, 2b extending inclined to its longitudinal axis or to the longitudinal axis of the base plate 1. The slots 2a, 2b are arranged parallel to each other and may be provided in the centre with a widened opening 14a, 14b which define a larger internal diameter than the diameter of the closure bow 3 and serve for easy insertion of the closure bow 3. The slots 2a, 2b have laterally of the widened opening a width corresponding substantially to the outer diameter of the closure bow 3.

If within its limited displacement region defined by the guide means 10a, 10d, the slots 2a, 2b and the portions of the closure bow 3 inserted through the slots 2a, 2b the locking member 2 is located in a position in which the closure bow ends or the bent regions 3d, 3e of the closure bow 3 come to lie within the widened bores 14a, 14b the closure bow 3 can then be freely pivoted over a predetermined region about its axis defined by the longitudinal portion 3c. The displacement of the locking member 2 parallel to the base plate 1 in the direction of the arrow A causes the closure bow 3, due to the inclined slots 2a, 2b, to move in the direction towards the ordering pins 6a, 6b whilst a displacement of the locking member 2 opposite to the direction of the arrow A causes an opening of the closure bow 3. This function applies for the locking member 2 in which the slots 2a, 2b starting from the widened bore 14a, 14b extend in the direction of the arrow A to the nearest outer edge 15 of the locking member 2 inclined as shown in FIG. 2. As soon as the locking member 2 has been displaced in the direction of the arrow A into the end position defined by the one end of the slot 2a and 2b the closure bow 3 has reached its closure position, whereupon the holder-down 4 previously placed on the ordering pins 6a, 6b can be brought into a clamping position for holding down the documents or the like. The holder-down may be formed by a plate-shaped element or by a stirrup-shaped element according to FIG. 2 which comprises an elevation in the centre and is provided laterally of the elevation with clamping slots 16a, 16b. Said clamping slots 16a, 16b lie parallel to each other in the direction of the longitudinal axis of the plate-shaped member. Said slots 16a, 16b referred to as clamping slots have a taper each in the same direction so that on displacement of the holder-down 4 oppositely for example to the direction of the arrow A in the embodiment shown in FIG. 2 the ordering pins coming to the region of smaller slot width and the holder-down 4 is thus clamped to the holding pins. The clamping slots 16a, 16b, as can be seen, have at their one end a width which is greater than the diameter of the ordering pins and at the other end a width which is slightly less than the diameter of the ordering pins 6a, 6b.

Although the holder-down 4 according to FIG. 2 has the form of a stirrup it is apparent that it could have a completely planar form; however, advantageously a grip or lug portion is provided for gripping by means of the fingers the holder-down 4 to enable the latter to be brought out of the clamping position into the freely displaceable position and vice versa.

Figure 3:
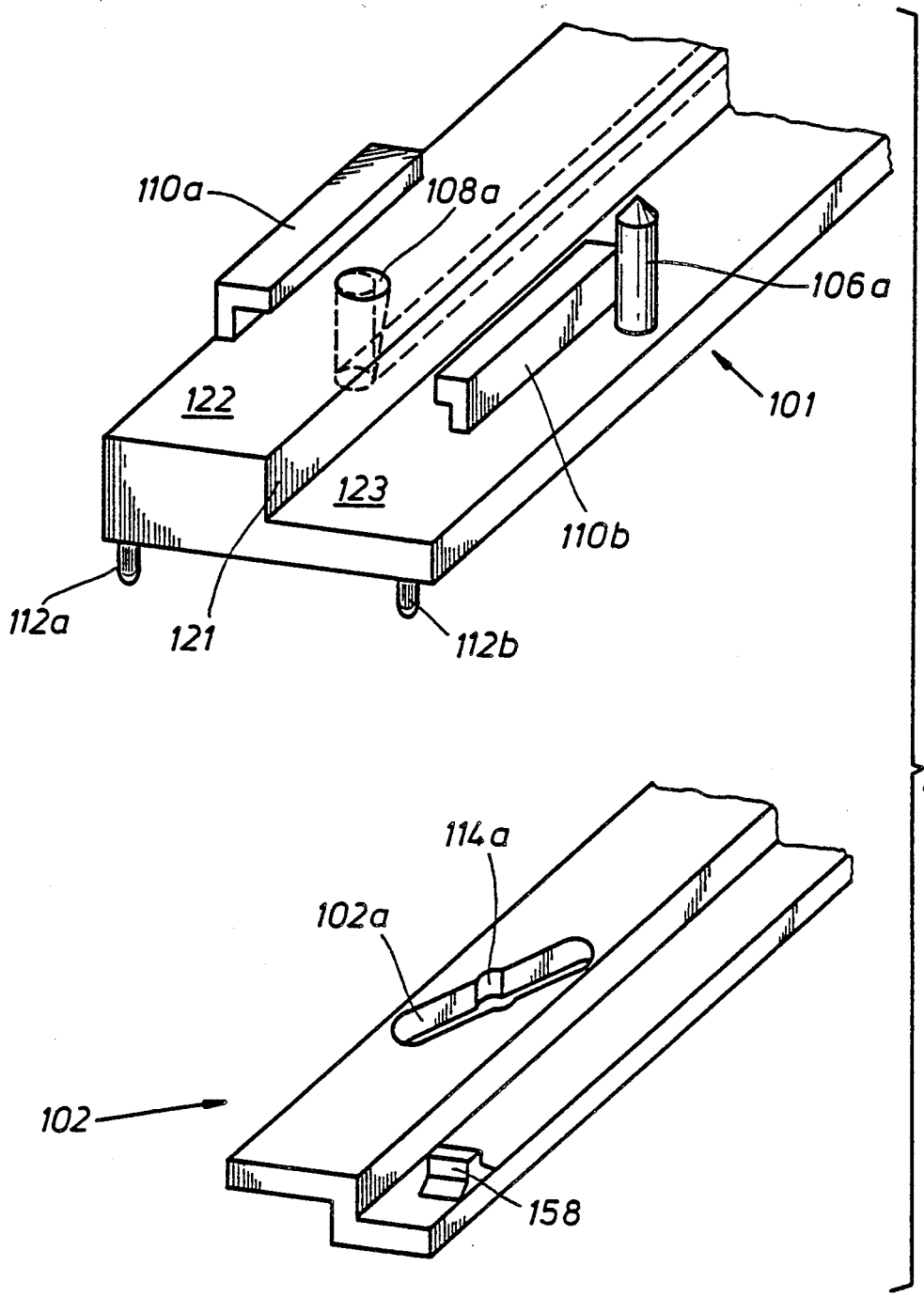
FIG. 3 shows a second embodiment of the ordering means in which the upper surface of the base plate and the locking member have an angled shape.

FIG. 3 shows an embodiment of an ordering means modified compared with FIGS. 1 and 2. The essential difference of the embodiment of FIG. 3 compared with the embodiment of FIGS. 1 and 2 resides in that the base plate 1 between the guide rails 10a, 10c and 10b, 10d has a step 20 so that the guide rails or guide means 10a, 10c come to lie at a higher level than the guide means 10b, 10d. This means that the surface of the base plate 1 according to FIG. 3 is in two spaced-apart planes, the spacing being governed by the step 20. The locking member 2 in the embodiment of FIG. 3 accordingly has an angled profile so that a displacement of the angled locking member 2 longitudinally of the base plate 1 is possible. As apparent from FIG. 3 on displacement of the locking member 2 a shifting of the inclined slots 2a, 2b along the higher surface 22 of the locking member 2 is effected, the openings 8a, 8b being provided in the higher surface 22 and the ordering pins 6a, 6b at the lower surface 23. The openings 8a, 8b have a form corresponding for example to a truncated cone, the larger opening face lying in the surface 22. The walls of the openings 8a, 8b extend in particular close to the step designated by 21 inclined with respect to the latter. In this embodiment a larger pivot range of the closure bow 3 is possible and thus a greater opening angle between the closure bow 3 and the ordering pins 6a, 6b. The reason is that the distance between the axis of rotation of the closure bow 3 and the surface 22 as support for the locking member 2 controlling the pivot movement of the closure bow 3 is substantially greater than in FIGS. 1 and 2. The associated pairs of guide rails 10a, 10b and 10c, 10c, provided opposite each other, are thus each on a different level. Instead of these guide rails 10a to 10d of L-shaped profile as described in conjunction with FIGS. 1 and 2 other guide elements may also be used.

Figure 4:
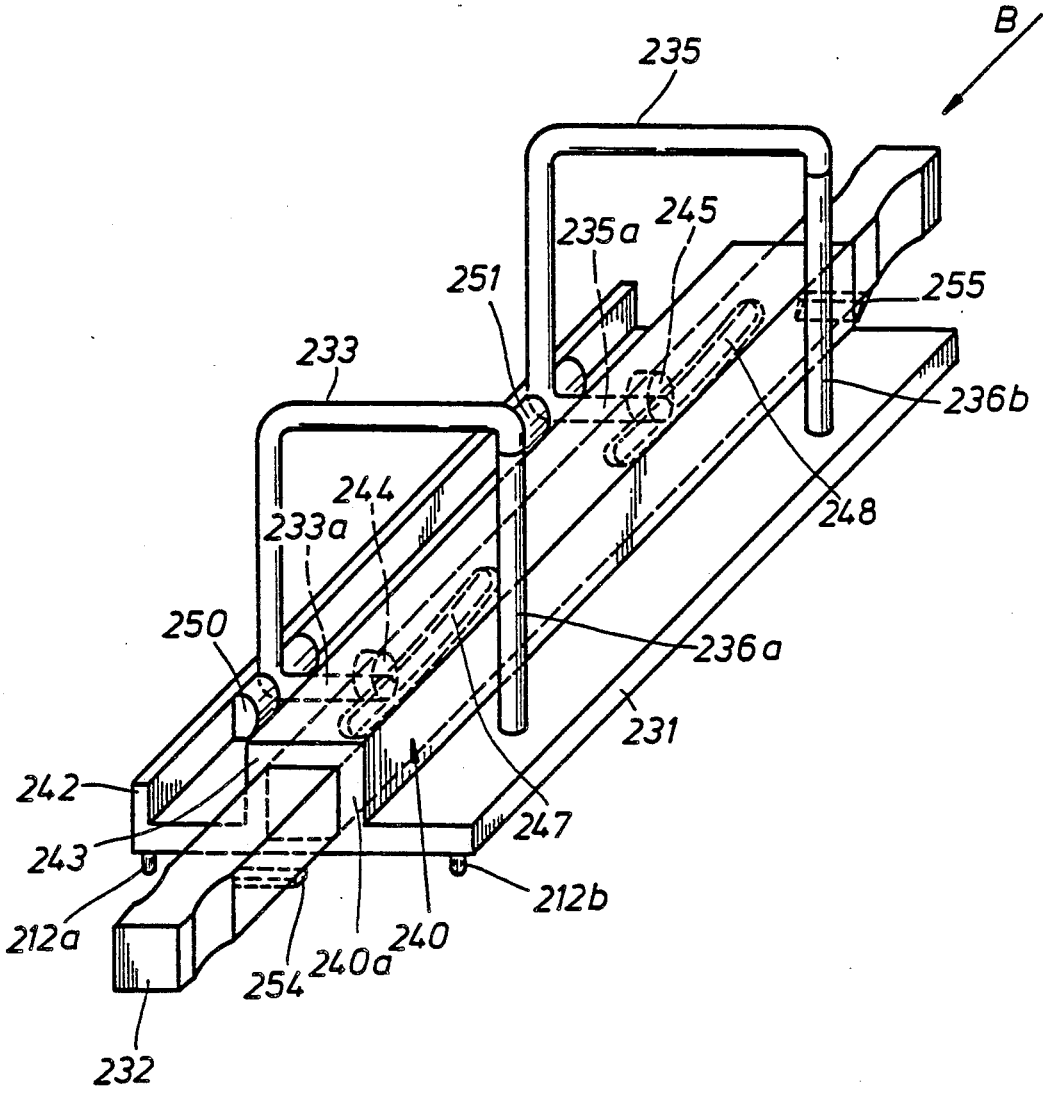
FIG. 4 is a third form of the ordering means, FIGS. 5*a* and 5*b* shown an embodiment modified compared with FIG. 4.

FIG. 4 shows a further modified embodiment of the ordering means. Said ordering means consists of a base plate 31, a locking member 32, at least two closure bows 33, 35 and a holder-down 4 of the type described in connection with FIGS. 1 to 3 and not illustrated in FIG. 4. Provided vertically upright on the base plate 31 are ordering pins 36a,36b which cooperate with the closure bows 33, 35. As guide means a guide passage 40 is provided in the base plate 31 and is integrated into said base plate 31 or provided on said base plate 31 and has a cross-sectional form adapted to the locking member 32. In the example of embodiment illustrated the locking member 32 has a square cross-section and consequently the guide passage 40 defines a square guide face making displacement of the locking member 32 along the guide passage 40 possible Instead of a continuous guide passage 40 individual guide passage sections may be formed on or in the base plate 31.

In this embodiment the guide passage or channel 40 serves not only to guide the locking member 32 on movement for opening and closing the closure bows 33, 35 but also to hold the closure bows 33, 35 themselves. For this purpose the guide channel or passage 40 comprises locally vertical slots 44, 45 in a side wall 43 opposite a web 42. The web 42 extends along the one end of the base plate 31 upwardly from the latter at an angle of about 90°. The slots 44, 45 permit a vertical displacement of the closure bow 33, 35 inserted into each of said slots 44, 45. Each closure bow 33, 35 comprises a substantially U-shaped form, the leg designated by 33a and 35a being inserted substantially parallel to the base plate 31 and pushed through the associated slot 44, 45 through the side wall 43 into the guide passage 40. In this manner the respective leg 33a, 35a reaches a guide groove 47, 48 extending inclined or curved and associated with said leg, said groove being worked from the side wall 43 into the locking member 32. Due to the inclination or the curved path of the guide groove 47, 48 in conjunction with the vertical slot 44, 45 on displacement of the locking or control member 32 in the direction of the arrow A a raising of the closure bows 33, 35 is effected and in the converse direction a lowering. The web 42 serves as abutment for the knee of the closure bow 33, 34 adjacent the leg 33a, 35a respectively whilst the depth of the guide grooves 47, 48 in the locking member 32 is made large enough for the knee of each closure bow 33, 35 to remain in engagement with the web 42. A movement of the closure bows 33, 35 with respect to the base plate 31 after insertion thereof into the position shown in FIG. 4 is prevented by bearings 50, 51 which in accordance with one embodiment each consist of two portions The associated bearing portions are spaced apart a distance corresponding to the thickness of the closure bows 33, 35 and disposed at the edge 42 pointing towards the guide passage 40. The bearing portions define between them a gap which extends transversely of the arrow direction B and serves as mounting in particular for the knee region of the respective closure bow 33, 35 adjacent the leg 33a, 35a. Depending on the movement of the locking member 32 in the direction of the arrow B or opposite thereto it is thus to effect raising and opening of the closure bow 33, 35 or lowering and closing of the closure bow 33, 35.

In the embodiment illustrated in FIG. 4 the locking member 32 may be displaced substantially above the upper surface of the base plate 31 in the longitudinal direction of the latter, i.e. the guide channel 40 is formed substantially on the base plate 31. The locking member 32 is inserted oppositely to the direction of the arrow B from the end side designated by 40a of the guide passage 40 into the latter and thereafter in succession the closure bow 33 and the closure bow 35 are inserted via the vertical slot 44 and 45 respectively into the associated guide groove 47, 48 and subsequently the closure bow 33, 35 still inclined to the base plate 31 is engaged in the mounting formed by a notch. To prevent unintentional pushing of the locking member 32 out of the guide passage 40 said locking member comprises near its one end a stop 54 provided at its lower surface whilst at the opposite end the locking member is provided likewise at its lower surface with a catch member 55 which is attached as flexible tab to the locking member 32 extending downwardly in the direction of the arrow B. This makes possible insertion of the locking member 32 through the guide passage 40 until said member reaches the position shown in FIG. 4 after emerging from the rear opening (FIG. 4) of the guide passage and the catch member 55 snaps downwardly and limits the movement of the locking member 32 in the direction of the arrow B.

All the individual parts are made from plastic, preferably glassfibre-reinforced plastic. The ordering pins 6a, 6b or 36a, 36b and/or the closure bows 3, 33, 35 consist of plastic or metal, preferably glassfibre-reinforced plastic. Preferably the individual parts described are made from glassfibre-reinforced plastic, thereby giving adequate stability. To ensure easy handling of the locking members 2, 32 the latter may be provided in accordance with FIGS. 2 and 3 with projections which facilitate manipulation thereof on displacement.

The guide slots 2a, 2b or guide grooves 47, 48 may be formed as rectilinearly extending slots or curved slots and substantially govern the degree of opening of the closure bows for a predetermined movement travel of the associated locking member.

The embodiments described each have two closure bows or two closure bow pairs. It is obvious that the number of closure bows can be increased if documents having more than two punched holes are to be ordered.

An ordering means for document files or the like* comprises a base plate which is provided with at least two fixed ordering pins. At least one movable closure bow can be brought into closure contact with the ordering pins. Possibly a holder-down is provided which is adapted to be clamped with respect to the ordering pins. A locking member displaceable with respect to the base plate serves to adjust the closure bow or bows and on the base plate guide means are provided for guiding the locking member. The locking member is provided with guide slots or guide grooves via which the locking member is in engagement with each closure bow so that on displacement of the locking member the respective closure bow can be opened or closed as explained above.

Figure 5A:
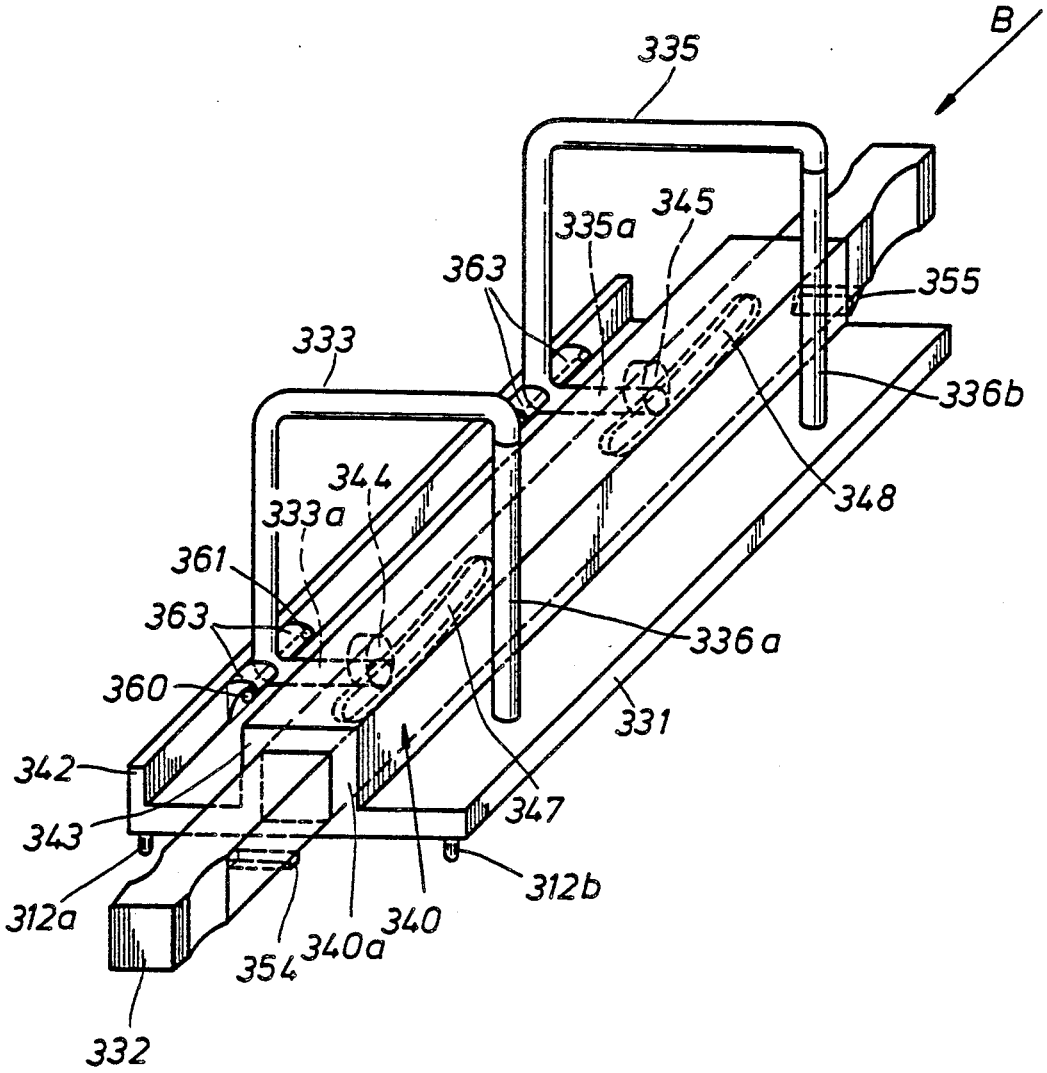
Figure 5B:
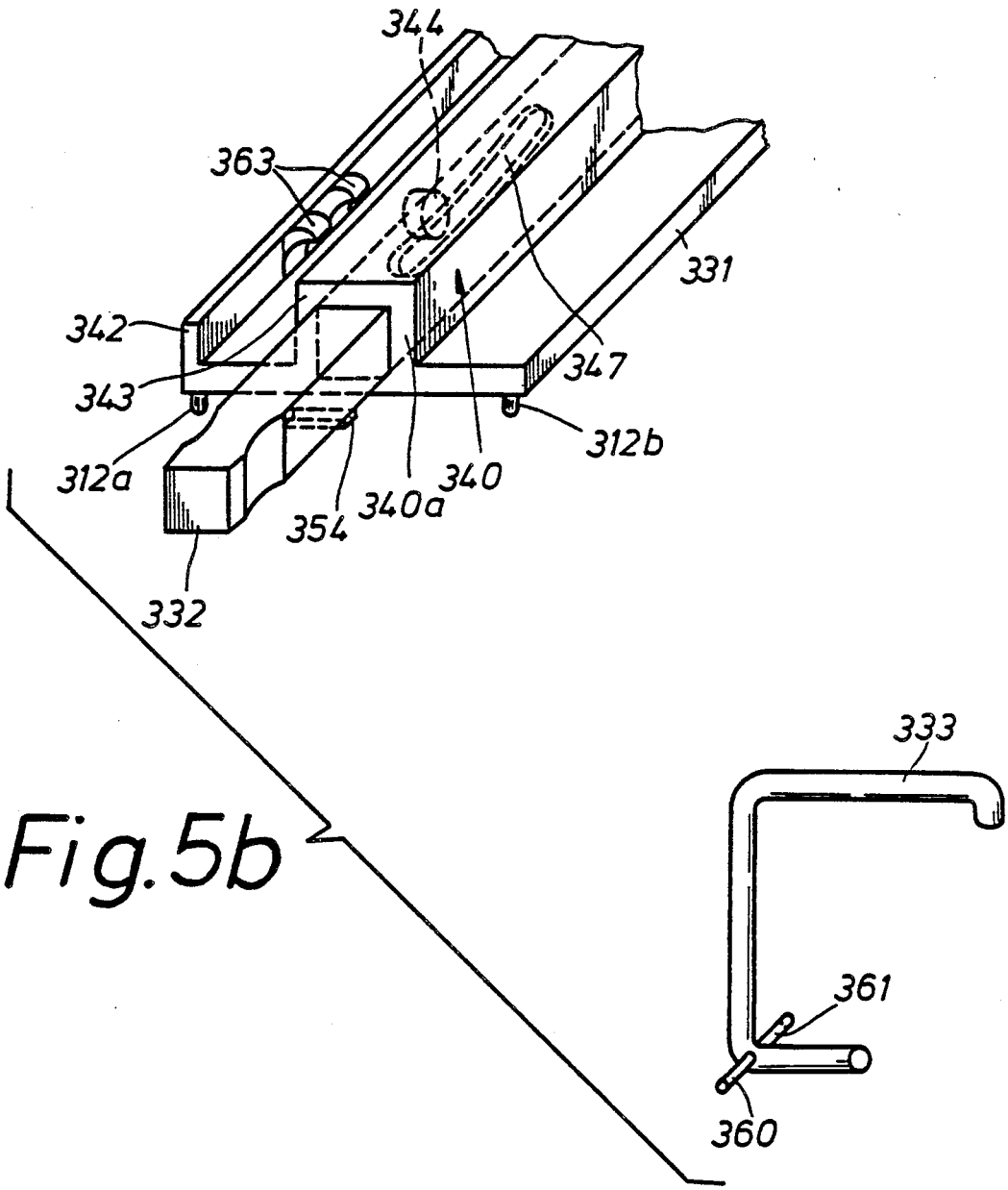

The embodiment shown in FIGS. 5a and 5b is modified compared with the embodiment of FIG. 4. According to FIGS. 5a and 5b on each of the closure bows 33, 35 bearing pins 60, 61 are provided which extend laterally of said bows and are formed at the curve following the portion 33a and 35a respectively and form a "cross" together with the respective closure bow. Said bearing pins 60, 61 serve to define an axis of rotation of the bow 33 and are engaged by bearing portions 63 as soon as the associated bow is inserted in the manner illustrated in FIG. 5a. The two bearing portions 63 associated with each other are spaced a distance apart corresponding substantially to the thickness of the closure bow 3 and are made projecting at the edge of the plate 31 denoted by 42 away from the edge in the direction towards the guide passage 43. As a result the bearing portions 63 form a mounting for the bearing pins 60, 61 and prevent the closure bows 33, 35 from springing out of the plate 31 upwardly. It is apparent from FIG. 5*b* that the bearing pins 60, 61 extend perpendicularly to the plane of the associated closure bow 33 and 35 respectively, the two bearing pins 60, 61 lying on a common axis.

Figure 6A:
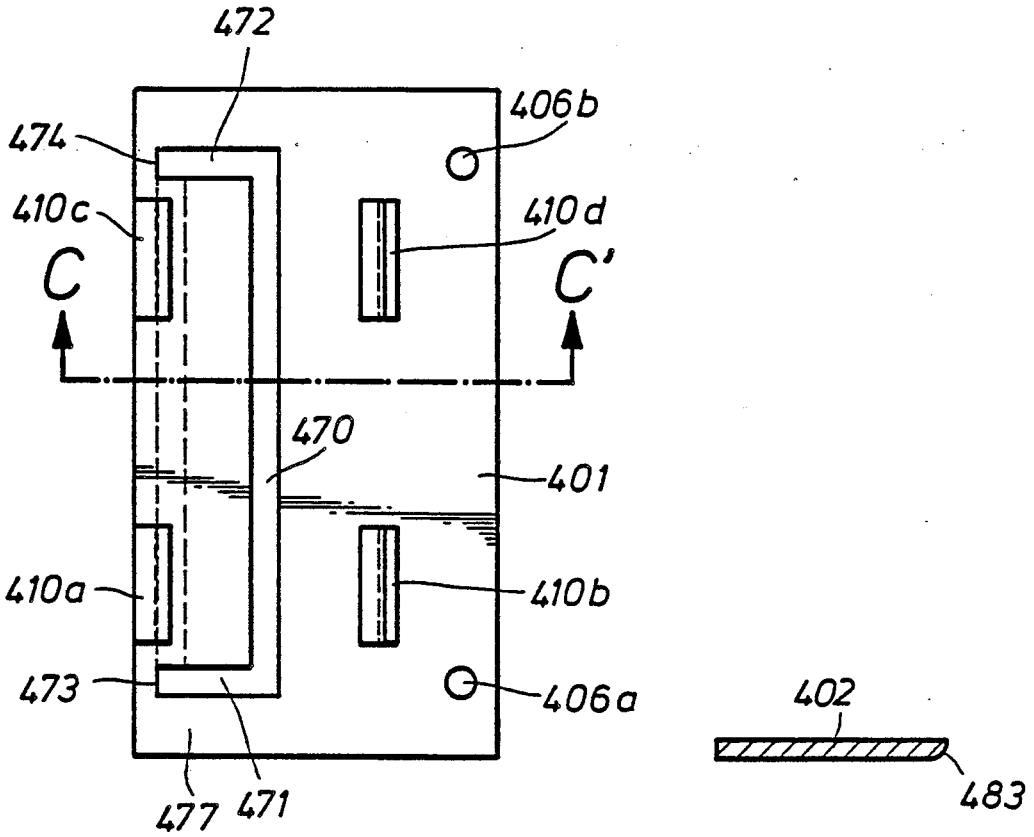
FIG. 6*a* is a plan view of a modified embodiment of the base plate.
Figure 6B:
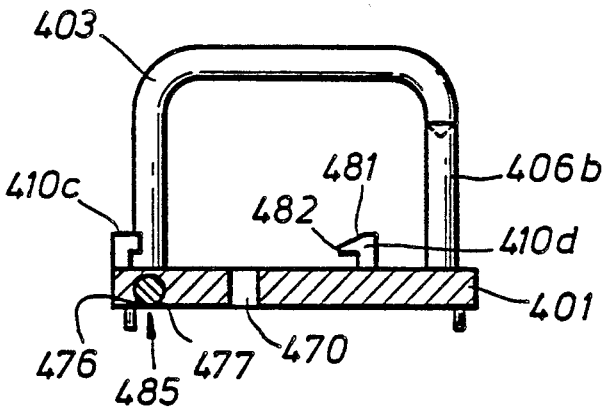
FIG. 6*b* is a sectional view of an ordering means with the base plate according to FIG. 6*a* along the line C—C and a sectional view through the associated locking member.

FIGS. 6*a* and 6*b* show a further modification of the ordering means according to the invention. The ordering means according to FIGS. 6*a* and 6*b* corresponds substantially to the embodiment described with reference to FIG. 1; in FIGS. 6*a* and 6*b* parts identical to the embodiment of FIGS. 1 to 3 are denoted by the same reference numerals. In so far as the embodiment of FIGS. 6*a* and 6*b* corresponds to the embodiment of FIGS. 1 and 2 the description of identical parts seems to be superfluous.

A difference compared with the embodiment of FIG. 1 in that of FIG. 6*a* is that a slot 70 is provided which extends in the axial direction of the plate 1 and which has a length which corresponds at least to the length of the leg portion 3*c* of the closure bow 3 (FIG. 2) and permits insertion of the closure bow 3 as the latter is described in conjunction with FIG. 2, from the upper side of the base plate 1. The closure bow 3 is inserted into the slot 70 in such a manner that its bow ends 3*a*, 3*b* are directed towards the ordering pins 6*a*, 6*b*. The width of the slot 70 is made slightly greater than the thickness of the closure bow 3. After insertion of the closure bow 3 with its base portion 3*c* into the slot 70 the closure bow is displaced in FIG. 6*a* towards the left along the guide slots 71, 72. The guide slots 71, 72 directly adjoin the slot 70 at the opposite ends thereof at an angle of about 90° and terminate at 73, 74 at a corresponding distance from the left edge of the base plate 1 in FIG. 6*a*. In the embodiment of FIG. 6*a* the guide slots 71, 72 are preferably formed symmetrically with the centre transverse axis of the base plate 1, said axis not being shown, and as a result a preferably central arrangement of the closure bow 3 is obtained. To mount the closure bow 3 firmly after its displacement out of the slot 70 via the guide slots 71, 72 at the ends 73, 74 a receiving groove 85 is provided in the lower surface of the base plate 1 with detent noses 76, 77. As soon as the closure bow 3 comes to lie with its base 3*c* beneath the receiving groove 85 it is drawn upwardly and due to the detent noses 76, 77 snaps firmly into the receiving groove 85.

Whereas in the embodiment of FIGS. 1 and 2 the closure bow 3, as described, must be pushed from the lower side of the base plate 1 through openings 8*a*, 8*b*, in the embodiment of FIGS. 6*a* and 6*b* a simplified insertion of the closure bow 3 is possible in the manner explained. The closure bow 3 can be provided with threaded-on locking member 2, i.e. fitted onto the closure bow 3, so that the locking member after engagement of the closure bow into the detent noses 76, 77 can be introduced by slight tilting with its one edge face 15 beneath the guide rails or guide elements 10*a*, 10*c*. Thereafter the locking member 2 is "snapped in" beneath the guide rails 10*b*, 10*d* in the region of its guide edge opposite the guide edge 15. For this purpose the guide rails 10*b*, 10*d* are made extending inclined in the manner shown in FIG. 6*b* so that the guide rails 10*b* and 10*d* in sectional view have the form of a hook and the upper surface 81 extends downwardly inclined towards the hook tip 82. The locking member 2 shown in sectional view in FIG. 6*b* is formed in corresponding manner in the region of its edge 83 facing the guide rails 10*b*, 10*d*, i.e. the edge is rounded at its downwardly directed face, facilitating the snapping in of the locking member 2 and the insertion of said member into the guide groove defined by the guide rails 10*b*, 10*d* into an arrangement substantially parallel to the base plate 1. Due to the fact that the guide rails 10*b*, 10*d* extend from the tip 82 in the direction towards the vertical wall of each guide rail 10*d*, 10*b* substantially rectilinearly, i.e. parallel to the base plate 1, unintentional snapping of the locking member 2 out of the guide groove defined by the guide rails 10*b*, 10*d* is prevented. After the insertion of the closure bow 3 the base portion 3*c* of the closure bow 3 is in the receiving groove 85 at the lower side of the base plate 1 (FIG. 6*b*) which is formed parallel to the longitudinal axis of the base plate 1 in the lower side of said plate and thus projecting of the base portion 3*c* beyond the lower surface of the base plate 1 is avoided. The detent noses 76, 77 prevent the base portion 3*c* slipping out of the receiving 85 (downwardly).

Figure 7C:
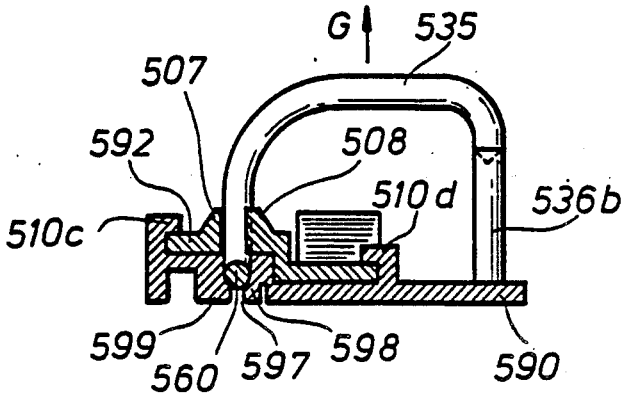
FIG. 7*c* is a sectional view through the ordering means according to FIG. 7*a* along the line D—D'.
Figure 7A:
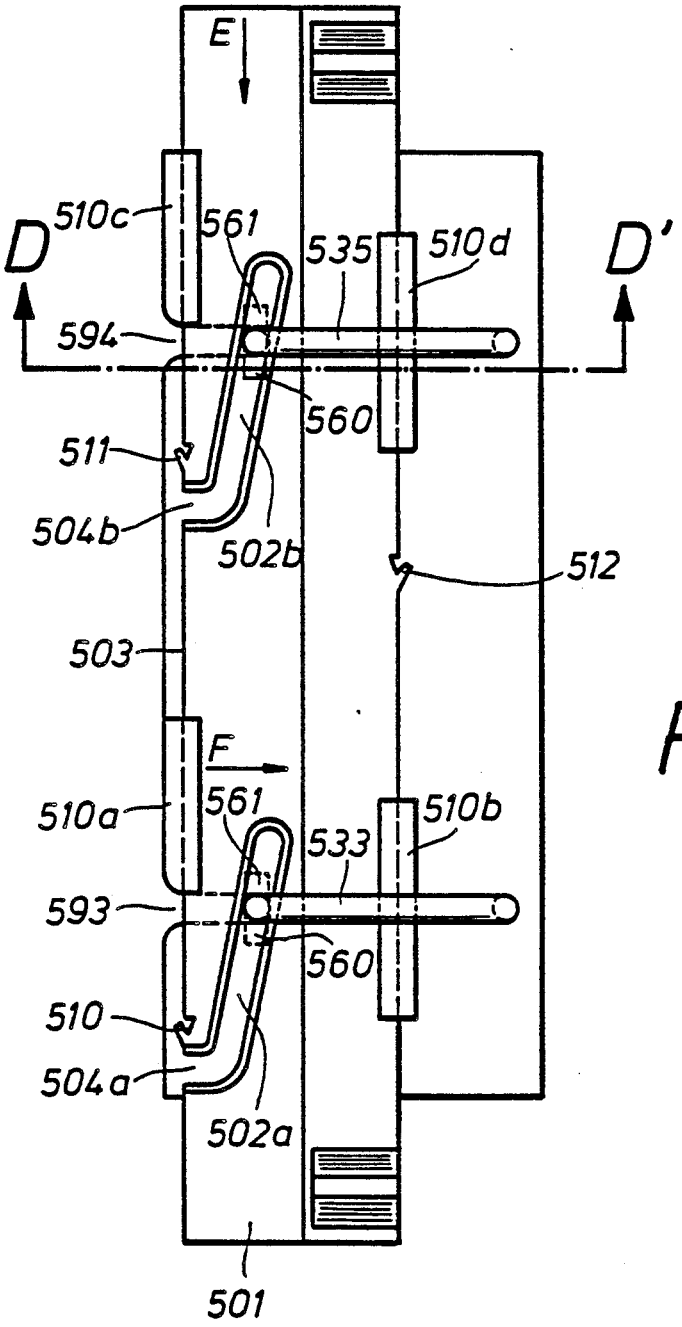
FIG. 7*a* is a plan view of a modified embodiment of the ordering means.
Figure 7B:
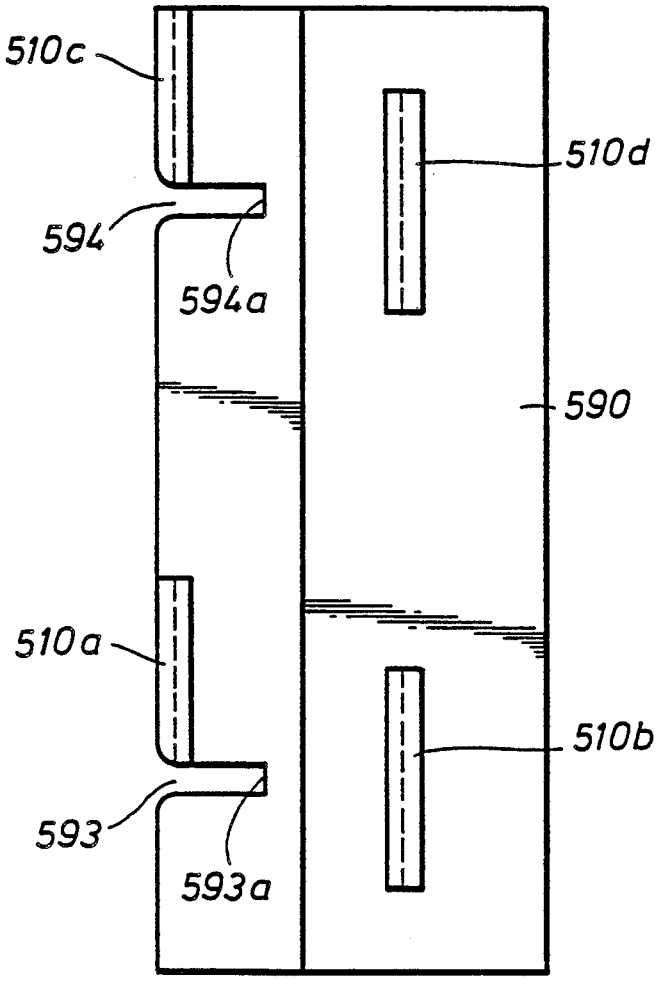
FIG. 7*b* is a plan view of the base plate.

FIGS. 7*a*, 7*b* and 7*c* show a modified embodiment of the ordering means compared with the embodiment of FIGS. 5*a* and 5*b* and according to FIGS. 7*a*, 7*b* and 7*c* individual closure bows 33, 35 of the type described in conjunction with FIGS. 5*a* and 5*b* are used. FIG. 7*a* is a plan view of the ordering device with inserted closure bows 33, 35 which each have laterally projecting bearing pins 60, 61 which are indicated in dashed line in FIG. 7*a*. The base plate 90 has according to FIGS. 7*a* to 7*c* a substantially stepped profiling similar to that described in conjunction with FIG. 3, said stepped or staircase profiling of the base plate 90 serving to increase the opening movement of the closure bows 33, 35 and to simplify the insertion of the larger stacks of paper. In corresponding manner the locking member, which is denoted by 91, is also made stepped in cross-section, guide rails 10*a*, 10*b*, 10*c* and 10*d* serving to guide the locking member 91 corresponding to FIGS. 1 to 3. As indicated in FIGS. 7*a* and 7*b* said guide rails are preferably offset with respect to each other, i.e. the pairs 10*a*, 10*b* on the one hand and 10*c* and 10*d* on the other do not lie above each other as provided in the embodiment of FIGS. 1 to 3 but mutually offset with respect to the longitudinal axis. The base plate 90 comprises for example introduction slots 93, 94 which extend centrally with respect to the guide rails 10*b*, 10*c* and which from the left side of the base plate 90 in FIG. 7*b* extend over a predetermined depth into said base plate 90. The end of each introduction slot 93, 94 denoted by 93*a* and 94*a* lies on a line in the longitudinal direction of the base plate 90 which is slightly laterally offset with respect to the desired axis of rotation of the two closure bows 33, 35. The introduction slots 93, 94 are provided in order to introduce the closure bows 33, 35 from the side face of the base plate 90 denoted by 95 into said base plate. During the introduction operation of the closure bows 33, 35 the latter are held by hand or in another manner in such a manner that the bearing pins 60, 61 lie beneath the lower surface of the base plate 90, whereupon the closure bows are displaced in the manner still to be described in the direction towards the guide rails 10*b* and 10*d*, i.e. transversely of the longitudinal direction of the base plate, until the bearing pins 60, 61 come to lie beneath the detent grooves, of which only one, denoted by 97, is shown in FIG. 7*c*. Thereafter the closure bows 30, 35 are moved upwardly in such a manner that the bearing pins 60, 61 overcome the forces generated by detent noses 98, 99 and engage into the associated detent groove 97. The detent grooves 97 serve for locking reception of the bearing pins 60, 61, as will be described below in conjunction with FIG. 7*c*.

The detent grooves 97 are formed on the lower side of the base plate 90 and fixed by lateral detent noses 98, 99 which prevent the bearing pins 60, 61 from coming out of the detent groove 97.

The locking member designated by 101 in FIG. *7a* comprises like the locking member of FIG. 3 inclined slots 102*a*, 102*b* which exert the same function as described in conjunction with FIGS. 1 to 3. The slots 102*a*, 102*b* are however not closed at their end towards the left guide edge 103 in FIG. *7a* but open towards said guide edge 103. This means in other words that the inclined slots 102*a*, 102*b* merge into a guide portion 104*a*, 104*b* extending transversely of the guide edge 103, the slots 102*a*, 102*b* and the guide portions 104*a*, 104*b* having a width corresponding substantially to the thickness of the closure bows 33, 35.

Introduction of the closure bows 33, 35 is as explained below. After preparation of the base plate 90 the locking member 101 is pushed for example in FIG. *7a* from above in the direction of an arrow E into the guide rails 10*c*, 10*d* and then further until the locking member also slides in the guide rails 10*a*, 10*b*. The insertion operation of the locking member 101 in the direction of the arrow E is continued until the guide portions 104*a*, 104*b* formed in the transverse direction of the locking member 101 in the latter come into coincidence with the insertion slots 93, 94 of the base plate 90. The locking member 101 is stopped and left in this position so as to permit the insertion of the closure bows 33, 35. The closure bows 33, 35 are inserted from the side denoted by 103 into the insertion slots 93, 94 and at the same time into the guide portions 104*a*, 104*b*, the bearing pins 60, 61 being disposed beneath the base plate 90, i.e. out of engagement with said base plate 90. Thereafter the locking member 101 is pushed further in the direction of the arrow E, resulting in a displacement of the closure bows 33, 35 in the direction of the arrow F, i.e. transversely of the longitudinal direction of the base plate 90 and to the right in FIG. *7a*. The displacement of the locking member 101 is continued until the closure bows 33, 35 are moved to the right, i.e. in the direction of the arrow F, to such an extent that the bearing pins 60, 61 come to lie beneath the detent groove 97. The closure bows 33, 35 are now rotatably mounted in the base plate 90 about an axis defined by the pins 60, 61 and by displacement of the locking member 101 in the direction of the arrow E can be closed with respect to the ordering pins 36*a*, 36*b* or on displacement of the locking member 101 opposite the direction of the arrow E can be opened with respect to the ordering pins 36*a*, 36*b*.

As indicated in FIG. *7c* the locking member 101 can be provided at its surface along the slots 102*a* 102*b* with enlargements 107, 108 which extend laterally above the slots and effect a stronger application of the closure bows and avoid material fatigue with respect to the locking member in the region of its slots 102*a*, 102*b*. To avoid unintentional pushing of the locking member 101 out in the embodiment of FIGS. *7a* to *7c* at the edge of the locking member denoted by 103 automatically erecting detent elements or detent hooks 110, 111 are provided which stand out inclined oppositely to the direction of the arrow E and as clearly shown in FIG. *7a* prevent displacement of the locking member oppositely to the direction of the arrow E over the guide rail 10*a* or 10*c* because they effect a locking with respect to said guide rails. Possibly a corresponding detent element can be provided on the guide edge of the locking member 101 opposite the guide edge 103, and is indicated in FIG. *7a* by the reference numeral 112. It is emphasized that the guide or control slots 102*a*, 102*b*, seen in FIG. *7a*, are closed at their upper sides whilst at their lower sides they are open outwardly through the guide portions 104*a*, 104*b*. The slots 102*a*, 102*b* extend as in the embodiments described above in FIG. *7a* from the top inclined downwardly and outwardly to the locking member 101 where they merge into the guide portions 104*a*, 104*b*.

As described in conjunction with the embodiments of FIGS. 1 to 5 in the embodiments of FIGS. 6 and 7 as well holders-down 4 are used. Fundamentally, in all embodiments two or more than two closure bows can be used although with regard to the embodiment of FIGS. 6 and 7 only two closure bows or one closure bow are shown.

All parts of the ordering means described can be made from plastic or from metal or combined from metal and plastic.

As the above remarks show, in particular as regards the embodiments of FIGS. 6 and 7 a substantially simplified introduction of the closure bows is ensured and this has a particularly advantageous effect as regards production costs of the ordering means according to the invention.

Hereinafter a further modification of the ordering means will be described in conjunction with FIGS. 8*a* to 8*c*. This ordering means represents a modification of the ordering means described in conjunction with FIGS. 1 and 2, identical parts compared with FIGS. 1 and 2 being provided with identical reference numerals In contrast to FIG. 1 the base plate 1 is provided in the region of the connecting portion 3*c* with a cutout as clearly apparent from FIG. 8*a*. The closure bow 3 is provided centrally or eccentrically of the connecting portion 3*c* with at least one stirrup-shaped portion 3*i* which projects from the axis of the connecting portion 3*c* and which in the embodiment according to FIG. 8*b* is made substantially rectangular and with the leg portions 3*g*, 3*f* in said embodiment includes a right angle with the remaining connecting portions denoted by $3c_1$, $3c_2$. The stirrup-shaped portion 3*i* may also have a substantially triangular shape or the shape of a bow. To permit a pivot motion of the closure bow 3 with respect to the base plate 1 the latter must be provided with a cutout at least in the region in which the portion 3*i* comes to lie in order to enable pivoting of said bow region 3*i* with respect to the base plate 1. The base plate 1 in FIG. 8*a* is accordingly cut out not only in a region corresponding to the portion 3*i* but also in the region of the legs $3c_1$, $3c_2$, giving a substantially T-shaped cutout. Said cutout is denoted by 201 in FIG. 8.

Figure 8C:
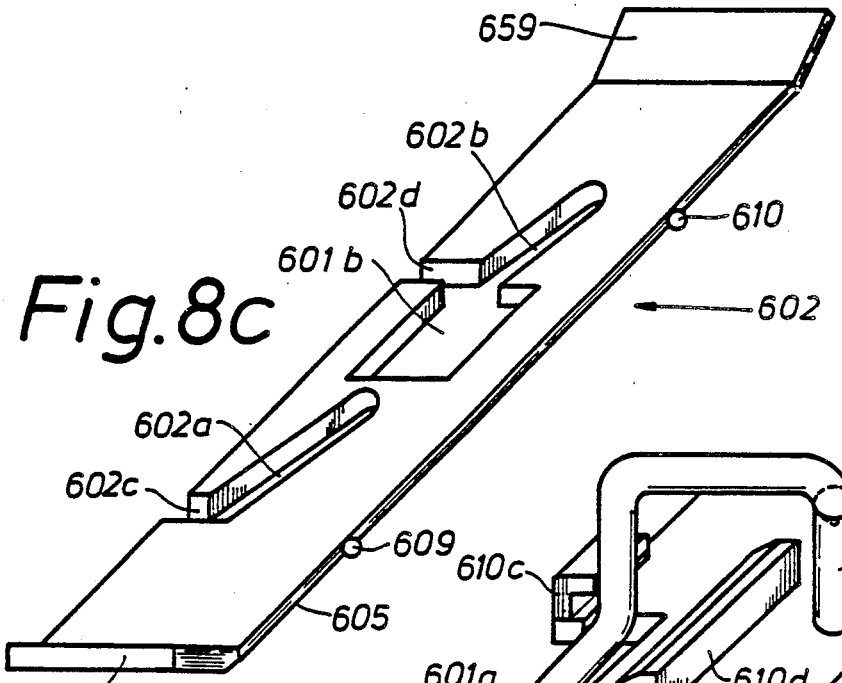
FIGS. 8*a* to 8*c* show a further modification of the ordering means compared with FIGS. 1 and 2.
Figure 8A:
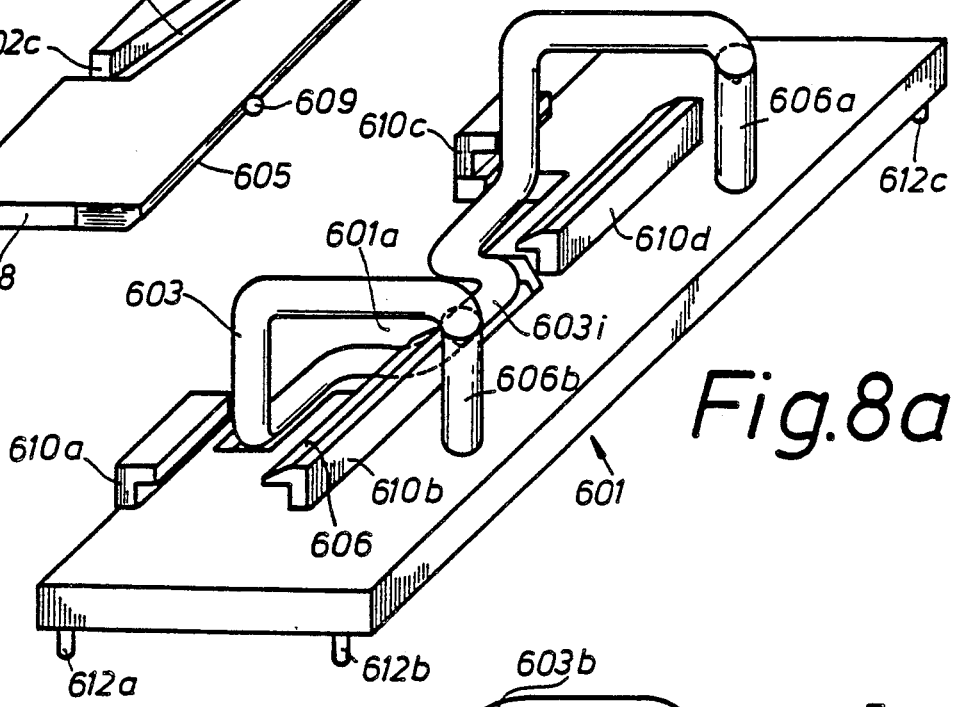
Figure 8B:
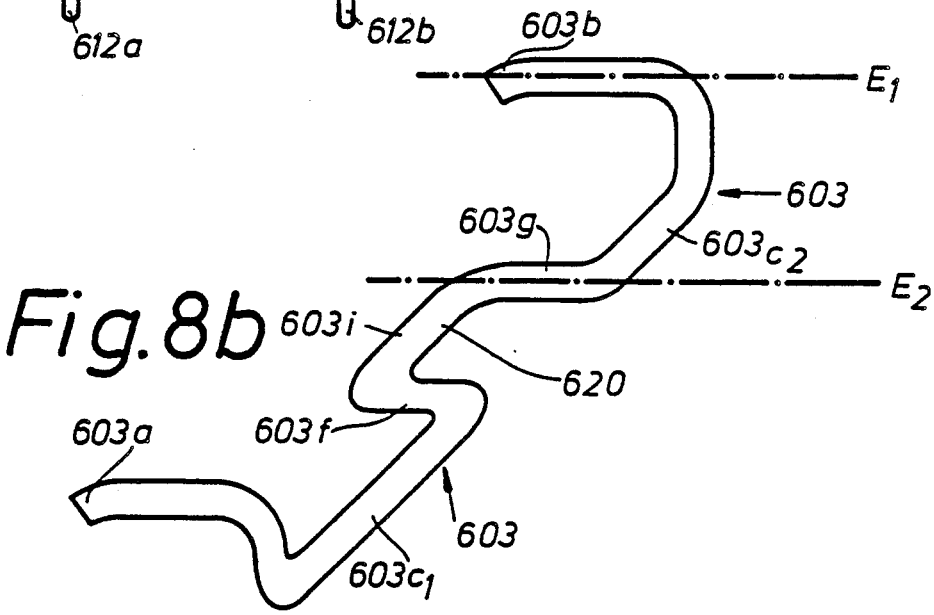

A corresponding cutout 202 is provided in the locking member 2, said cutout 202 for the closure bow shown in FIG. 8*b* having a length at least corresponding to the length of the portion 3*i* and a width corresponding to the length of the portion 3*f* or 3*g* and accordingly preferably having a rectangular form corresponding to FIG. 8*c*. As in the embodiment according to FIG. 2 for displacement of the locking member 2 slots 2*a*, 2*b* extending inclined to the axis of the locking member 2 are provided and are open at 2*c*, 2*d* towards the left edge of the locking member 2 in FIG. 8*c*. Said openings 2*c*, 2*d* permit a simpler assembly of the closure bow 3 with respect to the base plate 1 together with the locking member 2. As apparent from FIG. 8*c* the slot 2*b* can also open into the cutout 202. When the spacing between the ends 3*a*, 3*b* is substantially greater than shown in FIGS.

1, 2 and 8*b*, the slots 2*a*, 2*b* assume with their one end, not open to the outside, a greater distance from the cutout 202 and accordingly the slit 2*b* need also not open into the cutout 202.

In the embodiment of FIGS. 8*a* to 8*c* it is essential that the stirrup-shaped portion 3*i* comes to lie in a plane $E_2$ which includes a slight angle to the plane $E_1$. The plane $E_1$ is defined by the two ends 3*a*, 3*b*, i.e. said ends 3*a*, 3*b* lie in the plane $E_1$. Under this condition with the closure bow 3 closed in accordance with FIG. 8*a* and the ends 3*a*, 3*b* thereof resting on the ordering pins 6*a*, 6*b* it is achieved that the stirrup-formed portion 3*i* stands up slightly and by the locking member 2 a pressure is exerted on the portion 3*i*, ensuring an application pressure of predetermined magnitude between the ends 3*a*, 3*b* and the associated ordering pins. If the application pressure is to be made greater the portion 3*i* is shaped to stand up more in the direction towards the ends 3*a*, 3*b* than with a lesser application pressure.

Otherwise the ordering means has the construction already described in conjunction with FIGS. 1 and 2; in addition, for holding down sheets the holder-down illustrated in FIG. 2 can be used. The ordering device according to FIGS. 8*a* to 8*c* is suitable in particular for use in document files of relatively large thickness, i.e. for collecting a high stack of sheets with correspondingly relatively long ordering pins 6*a*, 6*b*.

It is apparent from the above remarks that in the embodiment of FIGS. 8*a* to 8*c* it is important that the closure bow has a stirrup-shaped portion 3*i* projecting out of the axis of the connecting portion 3*c* and extending slightly in the direction towards the free ends 3*a*, 3*b* in order to obtain the particular desired application pressure between the ends 3*a*, 3*b* and the ordering pins 6*a*, 6*b* by said portion 3*i* being pressed downwardly by the locking member 2.

According to a modification of the parts illustrated in FIGS. 8*a* and 8*c* the locking member 2 is downwardly bevelled at its right edge illustrated in FIG. 8*c* and indicated by the dashed line 205 whilst at the same time the guide rail 10*b*, 10*d* is given an upward bevelling corresponding to the dashed line 206. These bevellings 205, 206 make it possible to insert the locking member from above into the guide rails 10*a*, 10*b*, 1-*c*, 10*d* for example by inserting the locking member 2 with its left edge illustrated in FIG. 8*c* beneath the guide rail portions 10*a*, 10*c* and thereafter pressing said locking member 2 with its right edge in FIG. 8*c* via the facing bevellings downwardly into the guide rails 10*b*, 10*d*. The two ends 58, 59 provided for handling and extending inclined outwardly and upwardly with respect to the locking member 2 may possibly be omitted, particularly when the locking member 2 is to be inserted from the end side of the base plate 1 into the associated guide rails 10*a*, 10*b*, 10*c*, 10*d*.

According to a further modification of the locking member 2 shown in FIG. 8*c* said member 2 is provided at its left guide edge, or the right guide edge according to FIG. 8*c*, with projections 209, 210 which restrict the inserted locking member 2 as regards its movement relatively to the guide rails 10*a* to 10*d*. With these projections 209, 210 a limitation of the opening and/or closure travel of the closure bow 3 can be achieved. The projections 209, 210 may however also be designed so that the locking member can be forced beyond said projections, for example for insertion or pulling out from the guide rails.

I claim:

1. A filing device for document files comprising:

a base plate having at least two stationary sheet retainers projecting from the base plate;

said base plate further having movable sheet retainers being engaged with said base plate;

said base plate further comprising a guide passage being an integral part of said base plate for receiving a locking member and for allowing movement of the locking member with respect to the base plate along two moving directions being opposite to each other;

said guide passage being formed by horizontally offset guiding rails vertically projecting from said base plate;

said locking member being movably arranged above the base plate;

wherein the movable sheet retainers are pivotably supported by said base plate and are pivotably inserted into openings of the base plate such that they are vertically projecting from the base plate;

said locking member having guide slots being inclined with respect to said moving direction and being directly engaged with said movable sheet retainer such that movement of the locking member along said guiding rails opens and closes the movable sheet retainers, whereat the axis of rotation of the movable sheet retainers is arranged along the moving direction of the locking member;

wherein the base plate is plastic and is provided with openings for inserting said movable sheet retainers.

2. The device according to claim 1, wherein the openings in said base plate for receiving the movable sheet retainers are formed by bearings pivotably supporting said movable sheet retainers.

3. The device of claim 1, wherein the openings in the base plate for receiving the movable sheet retainers are formed by bearings pivotably supporting said movable sheet retainers; and wherein the bearings are arranged on an edge which is vertically projecting from the base plate.

4. The device of claim 1, wherein the locking member has a rectangular cross section.

5. The device of claim 1 wherein the locking member has a rectangular cross section;

wherein the guiding rails form a closed guiding channel for the locking member; and wherein the guiding channel is provided with lateral openings through which the movable sheet retainers are in engagement with the locking member.

6. The device of claim 1, wherein the movable sheet retainers comprise bearing pins being engaged with said bearings of the base plate.

7. The device of claim 1, wherein the guide slots are parallel to each other.

8. A filing device for document files comprising:

a base plate having at least two stationary sheet retainers projecting from the base plate;

said base plate further comprising movable sheet retainers being engaged with said base plate;

said base plate further comprising a guide passage being an integral part of said base plate for receiving a locking member and for allowing movement of the locking member with respect to the base plate along two moving directions being opposite to each other;

said guide passage being formed by horizontally offset guiding rails vertically projecting from said base plate;

said locking member being movably arranged above the base plate;

wherein the movable sheet retainers are pivotably supported by said base plate and are pivotably inserted into openings of the base plate such that they are vertically projecting from the base plate;

said locking member having guide slots being inclined with respect to said moving directions and being directly engaged with said movable sheet retainers such that movement of the locking member along said guiding rails opens and closes the movable sheet retainers, whereat the axis of rotation of the movable sheet retainers is arranged along the moving direction of the locking member;

wherein the base plate is plastic and is provided with openings for inserting said movable sheet retainers;

said movable sheet retainers having bearing pins engaged with bearing portions of said base plate;

said base plate comprising introduction slots for introducing the movable sheet retainers such that they are arranged with the bearing portion; and wherein the guiding rails are offset in a vertical direction.

9. A device of claim 8, wherein said base plate comprises an upper surface defining vertically spaced-apart first and second planes.

10. A device of claim 8, wherein the base plate having a step-shaped cross section such that it defines vertically spaced-apart first and second planes;

wherein said locking member comprises vertically spaced-apart first and second planes overlying the vertically spaced-apart planes of said base plate.

11. A device of claim 8, wherein said locking member comprises detent hooks being engageable with said guiding rails.

12. A device of claim 8, wherein the guide slots are provided parallel to each other in the locking member.

13. A filing device for document files comprising:

a base plate having at least two stationary sheet retainers projecting from the base plate, and movable sheet retainers being engaged with said base plate;

said base plate further comprising a guide passage being an integral part of said base plate for receiving a locking member and for allowing movement of the locking member with respect to the base plate along two moving directions being opposite to each other;

said guide passage being formed by horizontally offset guiding rails vertically projecting from said base plate;

said locking member being movably arranged above the base plate;

wherein the movable sheet retainers are pivotably supported by said base plate and are pivotably inserted into openings of the base plate such that they are vertically projecting from the base plate;

said locking member having guide slots being inclined with respect to said moving direction and being directly engaged with said movable sheet retainers such that movement of the locking member along said guiding rails opens and closes the movable sheet retainer, whereat the axis of rotation of the movable sheet retainers is arranged along the moving direction of the locking member;

wherein the base plate is plastic and is provided with openings for inserting said movable sheet retainers;

wherein said openings of the base plate are forming a cutout for receiving a connecting portion which is connecting the movable sheet retainers; and wherein the locking member comprises a cutout which opens into one of said guide slots.

14. A device of claim 13, wherein said locking member is comprised of a plate being arranged in a plane parallel to said base plate.

15. A device of claim 13, wherein the guide slots are provided parallel to each other in the locking member.

16. A device of claim 13, wherein the guide means are provided on the upper face of the base plate.

17. A device of claim 13, wherein the connecting portion between the movable sheet retainers comprises a bow.

* * * * *